US006572385B1

(12) United States Patent
Wu

(10) Patent No.: US 6,572,385 B1
(45) Date of Patent: Jun. 3, 2003

(54) LOW PROFILE ELECTRICAL CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,656

(22) Filed: Dec. 20, 2001

(51) Int. Cl.[7] ..... H01R 12/00
(52) U.S. Cl. ..... 439/60; 439/636
(58) Field of Search ..... 439/636, 637, 439/60, 326, 328, 62, 65

(56) References Cited

U.S. PATENT DOCUMENTS 5,876,214 A * 3/1999 McHugh et al. ..... 439/60
6,174,187 B1 * 1/2001 Yamagami et al. ..... 439/326
6,296,491 B1 * 10/2001 Pickles ..... 439/60

* cited by examiner

*Primary Examiner*—P. Austin Bradley
*Assistant Examiner*—Alexander Gilman
(74) *Attorney, Agent, or Firm*—Wei Te Chung

(57) ABSTRACT

A low profile electrical connector (4) includes an insulative housing (5), a number of electrical contacts (6) and a pair of boardlocks (7) retained to the insulative housing. The insulative housing has a number of passageways (505) extending vertically through a longitudinal side (500) thereof and two slots (504). The passageways communicate with the slots through longer and shorter openings (508), (509). Each electrical contact has a retention portion (60), a transitional portion (62), and a curved contact section (64). The curved contact sections protruding through the longer openings into the slots are located vertically higher than the curved contact sections protruding through the shorter openings. Both the retention and the transitional portions of the electrical contacts corresponding to the longer openings engage with the insulative housing while only the retention portions of the electrical contacts corresponding to the shorter openings engage with the insulative housing.

6 Claims, 5 Drawing Sheets

LOW PROFILE ELECTRICAL CONNECTOR

BACKGROUND OF THE INVENTION

1. Field of the Invention

The present invention relates to an electrical connector, and particularly to a low profile electrical connector.

2. Description of the Related Art

More and more low profile electrical connectors are being used in compliance with the miniaturization trend in the present electronic field. Referring to FIGS. 9-11, one type of low profile electrical connector 1 comprises an insulative housing 2 having a mating portion 20 and a mounting portion 22, and a plurality of electrical contacts 3. A height D is defined between a mating face 200 of the mating portion 20 and a mounting face 220 of the mounting portion 22. The mating portion 20 defines a longitudinal slot 203 therein and a plurality of passageways 201 extending vertically therethrough and communicating with the slot 203 through longer and shorter openings 206, 205 defined in lower sections of inner side walls 207 of the passageways 201.

The electrical contacts 3 are inserted into the passageways 201, respectively, and each has a curved contact section 30 protruding through the openings 205, 206 into the slot 203 and a vertical retention portion 31 having an engaging section 32 engaging with the mating portion 20. The curved contact section 30 of the electrical contact 3 corresponding to the shorter opening 205 is situated vertically lower than the curved contact section 30 of the electrical contact 3 corresponding to the longer opening 206, and the length B of the engaging section 32 of the electrical contact 3 corresponding to the shorter opening 205 is smaller than the length A of the engaging section 32 of the electrical contact 3 corresponding to the longer opening 206.

As is clearly shown in FIGS. 9 to 11, the retention portion 31 of the electrical contact 3 corresponding to the shorter opening 205 has still a section which is located below the engaging section 32 without engaging with the mating portion 20, so the retention therebetween is unreliable. In addition, both the length A and the length B of the engaging sections 32, through which the electrical contacts 3 engage with the mating portion 20, are small due to the limited height D, as determined by practical applications or industrial standards, thereby further reducing the reliability of the retention between the electrical contacts 3 and the insulative housing 2.

It has been proposed to improve the retention between the electrical contacts 3 and the insulative housing 2 by increasing the height D of the insulative housing 2 or changing the shapes of the electrical contacts 3. However, increasing the height D of the insulative housing 2 unavoidably increases a total height of the electrical connector 1, which is undesired to most practical applications or industrial standards. In addition, changing the shapes of the electrical contacts 3 always results in complicated manufacturing procedures and increased manufacturing cost.

Therefore, an improved low profile electrical connector is desired to overcome the disadvantages of the related art.

SUMMARY OF THE INVENTION

A major object of the present invention is to provide a low profile electrical connector having electrical contacts reliably retained to an insulative housing thereof.

Another object of the present invention is to provide a low profile electrical connector which improves the retention between electrical contacts thereof and an insulative housing thereof without changing a total height thereof and the electrical contacts themselves.

A low profile electrical connector in accordance with the present invention comprises an insulative housing, a plurality of electrical contacts and a pair of boardlocks retained to the insulative housing. The insulative housing comprises a pair of slots and a plurality of passageways extending vertically therethrough and communicating with the slots through longer and shorter openings. Each electrical contact comprises a retention portion completely engaging with the insulative housing, a transitional portion extending from the retention portion, and a curved contact section protruding through the longer and the shorter openings into the slots. The curved contact sections of the electrical contacts corresponding to the longer openings are located vertically higher than the curved contact sections of the electrical contacts corresponding to the shorter openings and the transitional portions of the electrical contacts corresponding to the longer openings engage with the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
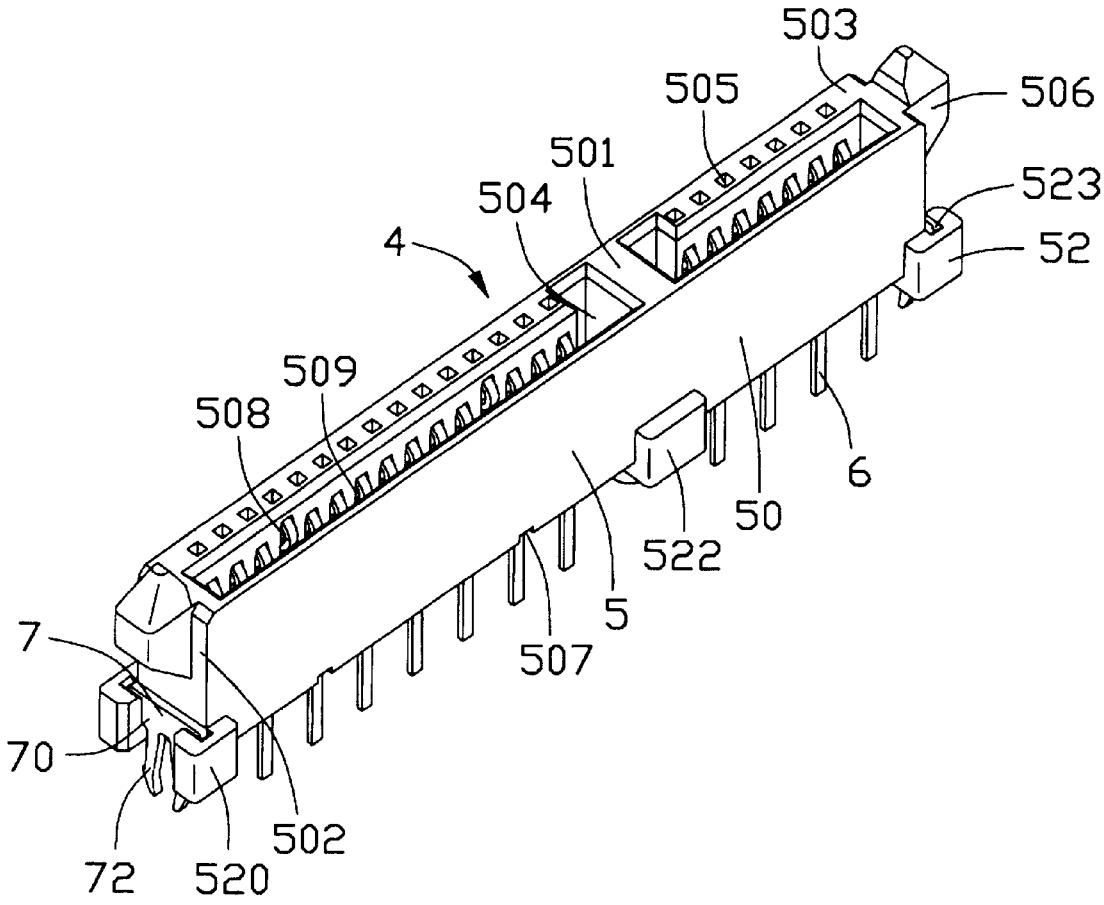
FIG. 1 is a perspective view of a low profile electrical connector in accordance with the present invention.

Referring to FIG. 1, a low profile electrical connector 4 in accordance with the present invention comprises an insulative housing 5, a plurality of electrical contacts 6 and a pair of boardlocks 7.

Figure 2:
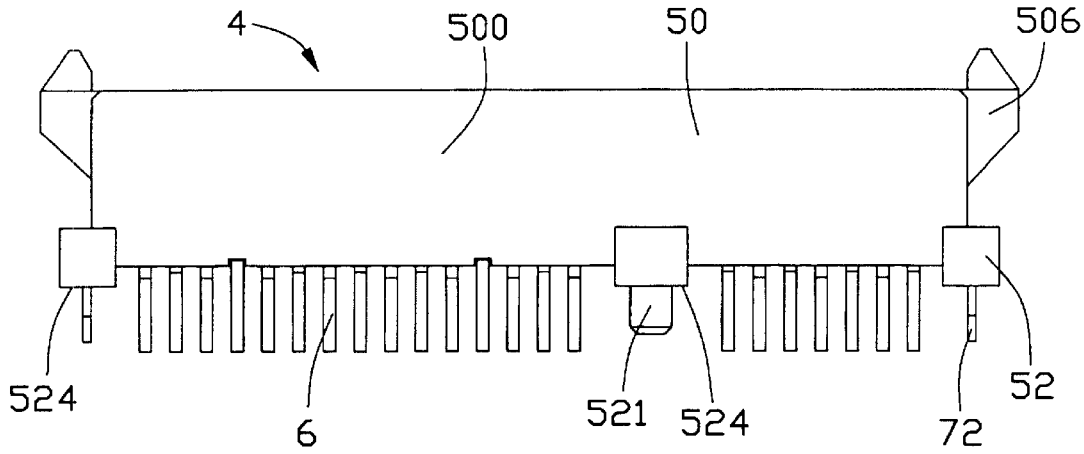
FIG. 2 is a front view of the low profile electrical connector of FIG. 1.
Figure 3:
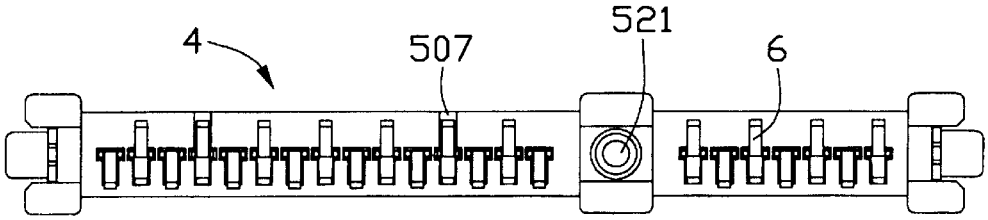
FIG. 3 is a bottom view of the low profile electrical connector of FIG. 1.
Figure 4:
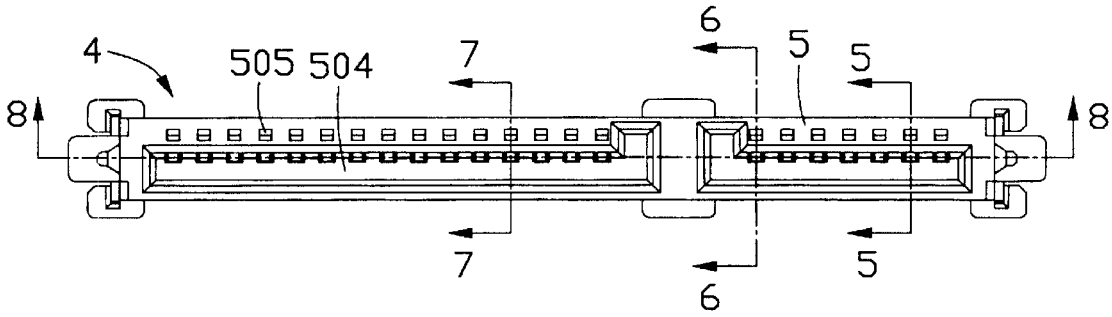
FIG. 4 is a top plan view of the low profile electrical connector of FIG. 1.

Referring also to FIGS. 2–4, the insulative housing 5 comprises an elongated mating portion 50 and a mounting portion 52. The mating portion 50 comprises a pair of longitudinal sides 500, a pair of lateral ends 502 connecting opposite ends of the longitudinal sides 500, and an intermediate wall 501 extending parallelly between the lateral ends 502 and connecting with the lonitudinal sides 500. The longitudinal sides 500, the lateral ends 502 and the intermediate wall 501 confine two slots 504 therebetween. One of the slots 504 is longitudinally longer than the other of the slots 504. One of the longitudinal sides 500 is thicker in the lateral direction than the other of the longitudinal sides 500 and defines a plurality of passageways 505 extending vertically therethrough. A pair of longer openings 508 and a plurality of shorter openings 509 are defined in one side of the passageways 505 and each expose a corresponding passageway 505 to the slot 504. The longer openings 508 extend vertically longer than the shorter openings 509 with reference to the bottom 53 (FIG. 5) of the slot 504. A pair of channels 507 are recessed from a bottom face of the mating portion 50 and communicate with the passageways 505 corresponding to the longer openings 508. A guiding post 506 extends upwardly from an upper section of each lateral end 502 and beyond a mating face 503 of the mating portion 50.

The mounting portion 52 comprises a pair of end blocks 520 extending downwardly and outwardly from lower sections of the lateral ends 502, respectively, an intermediate block 522 extending downwardly from an intermediate section of the mating portion 50, and a positioning post 521 extending downwardly from the intermediate block 522. Bottom faces of the end blocks 520 and the intermediate block 521 are flush with each other and are located below the bottom face of the mating portion 50 to define a mounting face 524, through which the low profile electrical connector 4 is mounted to a printed circuit board (not shown). Each end block 520 defines a slit 523 extending vertically therethrough and adjacent to the lateral end 502. A height D' (FIG. 7) is defined between the mating face 503 of the mating portion 50 and the mounting face 524 of the mounting portion 52 and is the same as the corresponding height of a conventional low profile electrical connector.

Referring also to FIGS. 5 to 8, all of the electrical contacts 6 are in the same dimension and in similar shapes as conventional electrical contacts used in conventional low profile electrical connectors. Each electrical contact 6 comprises a vertical retention portion 60, a mounting portion 61 for mounting the electrical contact 6 to the printed circuit board, a transitional portion 62 between the vertical retention portion 60 and the mounting portion 61, and a resilient arm 63 extending upwardly from the vertical retention portion 60. Each resilient arm 63 comprises a curved contact section 64 in an upper section thereof.

Each boardlock 7 comprises a body portion 70 and a pair of spaced legs 72 extending downwardly from the body portion 70.

In assembly, the body portions 70 of the boardlocks 7 are received and retained, in ordinary ways known to persons skilled in the pertinent art, in the slits 523 of the end blocks 520. The legs 72 of the boardlocks 7 extend downwardly beyond the mounting face 524 to be inserted into appropriate holes in the printed circuit board to which the low profile electrical connector 4 is mounted.

Figure 7:
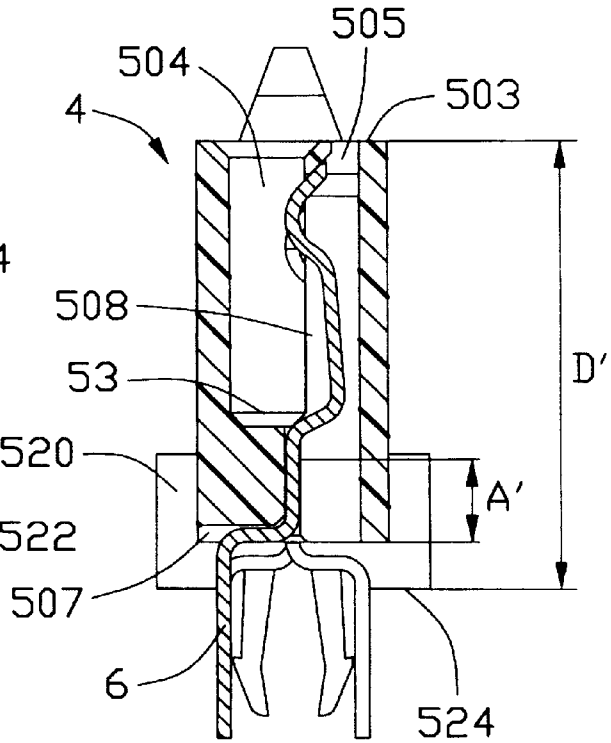
FIG. 7 is a cross-sectional view taken along line 7—7 of FIG. 4.
Figure 6:
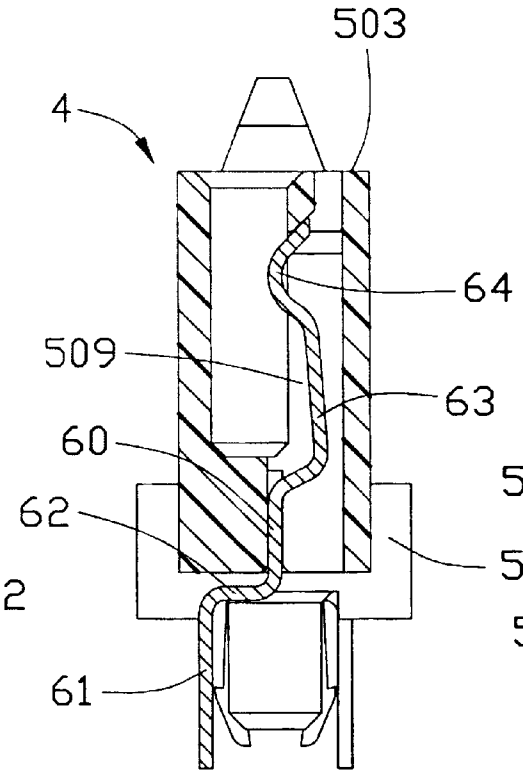
FIG. 6 is a cross-sectional view taken along line 6—6 of FIG. 4.
Figure 5:
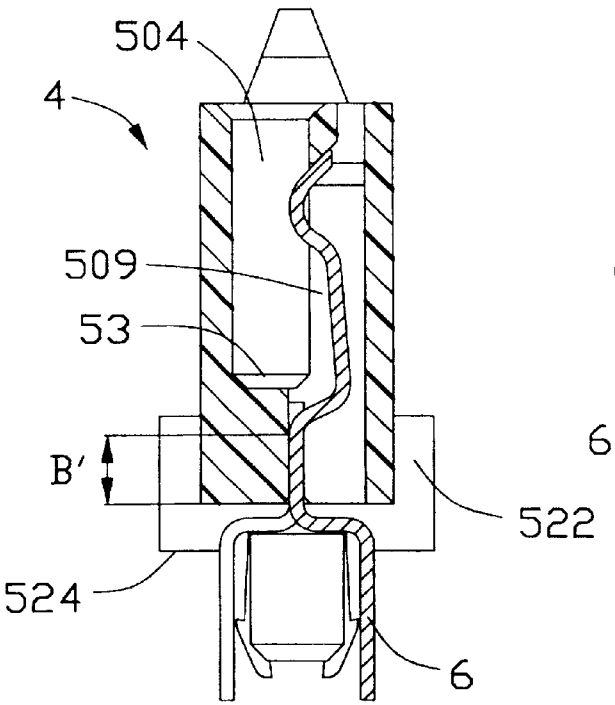
FIG. 5 is a cross-sectional view taken along line 5—5 of FIG. 4.
Figure 8:
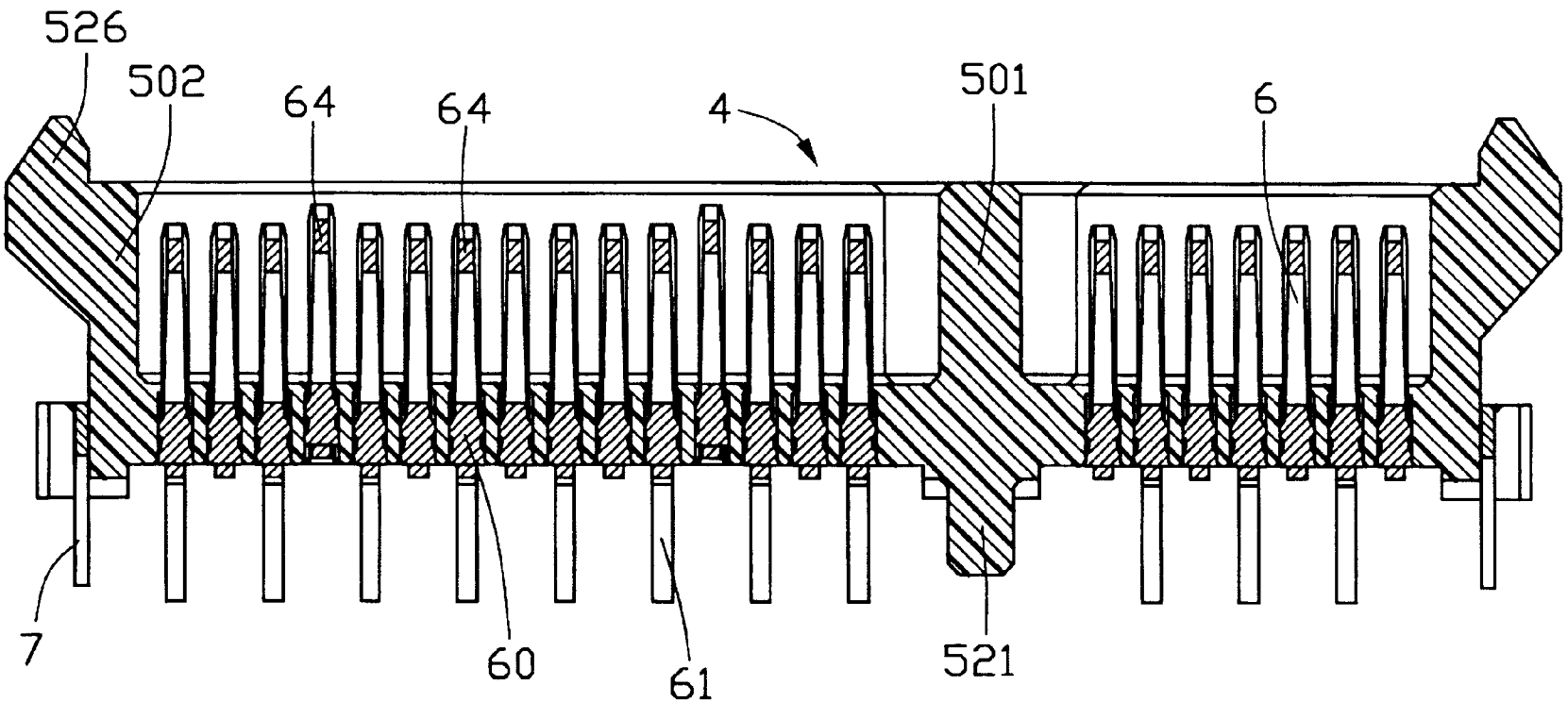
FIG. 8 is a cross-sectional view taken along line 8—8 of FIG. 4.
Figure 11:
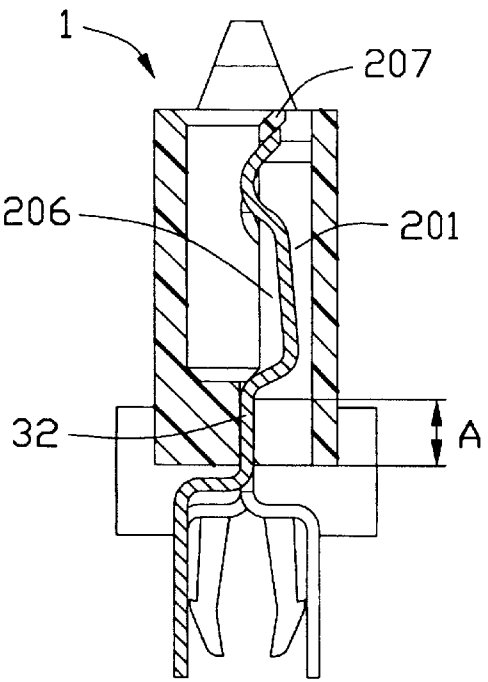
FIG. 11 (RELATED ART)
FIGS. 9–11 are cross-sectional views of a conventional low profile electrical connector.
Figure 10:
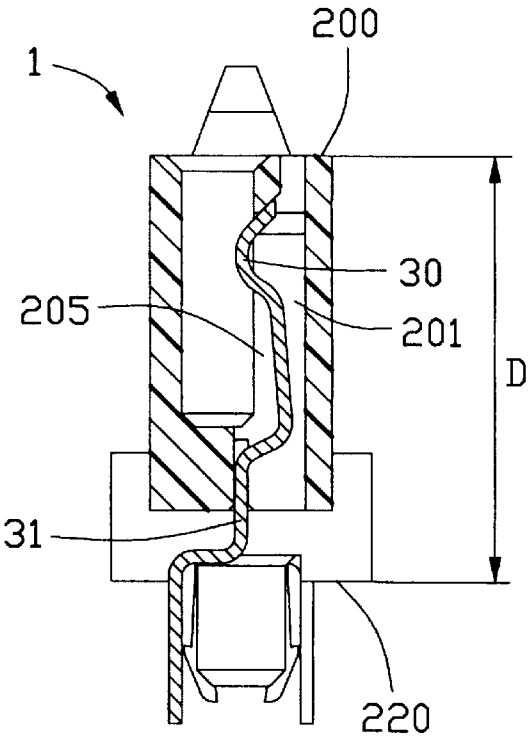
FIG. 10 (RELATED ART)
Figure 9:
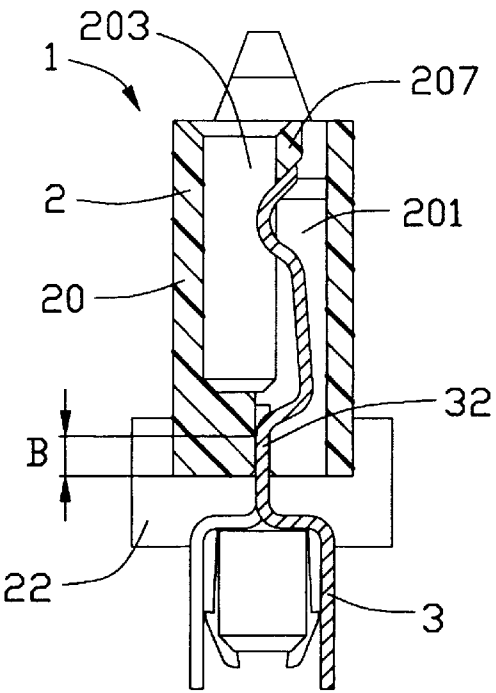
FIG. 9 (RELATED ART)

The electrical contacts 6 are inserted into corresponding passageways 505 of the mating portion 50. The vertical retention portions 60 of the electrical contacts 6, as shown in FIGS. 5–7, completely engage with the mating portion 60 in ordinary ways known to persons skilled in the pertinent art and the curved contact sections 64 protrude through the longer and the shorter openings 508, 509 into the slots 504 with the free ends thereof engaging with the mating portion 50 to impact pre-loading force to the electrical contacts 6. The transitional portions 62 of the electrical contacts 6 in the passageways 505 corresponding to the longer openings 508 are received and retained in the channels 507 and the curved contact sections 64 of the corresponding electrical contacts 6 extend vertically higher than the curved contact sections 64 of the electrical contacts 6 in the passageways 505 corresponding to the shorter openings 509. The transitional and the mounting portions 62, 61 are alternately located below either of the two longitudinal sides 500 to be arranged in two parallel rows.

All of the electrical contacts 6 are in the same dimension as conventional electrical contacts while the retention portion 60 thereof completely engages with the mating portion 50, thereby increasing the lengths A', B', which determine the engaging areas of the electrical contacts 6 with the insulative housing, and in turn improving the retention therebetween. In addition, the transitional portions 62 of the electrical contacts 6 corresponding to the longer openings 508 are retained in the channels 507, which further increases the retention therebetween. Furthermore, a height D' defined between the mating face 503 and the mounting face 524 remains the same as the conventional electrical connector, thereby complying with most practical applications or industrial standards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A low profile electrical connector comprising:

an insulative housing comprising a mating portion defining a plurality of first passageways, a plurality of second passageways, a plurality of channels and a slot; and a plurality of electrical contacts being received in the first and the second passageways, respectively, each electrical contact comprising a retention portion engaging with the insulative housing, a resilient arm extending from the retention portion and having a curved contact section protruding into the slot, and a transitional portion extending from the retention portion and arranged below the mating portion, the transitional portion of the electrical contact received in the first passageway being fully received in the channel of the insulative housing, wherein the mating portion of the insulative housing comprises a plurality of first openings exposing the first passageways to the slot and a plurality of second openings vertically shorter than the first openings and exposing the second passageways to the slot, and wherein the curved contact section of the electrical contact received in the first passageway is located higher than the curved contact section of the electrical contact received in the second passageway; wherein the curved contact section of the electrical contact received in the first passageway extends vertically higher than the curved contact of the electrical contact received in the second passageway.

2. The low profile electrical connector as claimed in claim 1, wherein the insulative housing comprises a pair of longitudinal sides, a pair of lateral ends, and an intermediate wall to confine two slots therebetween, one of the two slots being longer than another of the two slots.

3. The low profile electrical connector as claimed in claim 1, wherein the insulative housing comprises a pair of longitudinal sides and wherein one of the pair of longitudinal sides defines the first and the second passageways extending vertically therethrough.

4. The low profile electrical connector as claimed in claim 1, wherein the insulative housing comprises a mating portion defining a plurality of channels and wherein each channel receives the transitional portion of the electrical contact received in the first passageway.

5. The low profile electrical connector as claimed in claim 1, further comprising a pair of boardlocks, and wherein the insulative housing comprises a pair of end blocks to retain the pair of boardlocks.

6. The low profile electrical connector as claimed in claim 1, wherein each electrical contact comprises a mounting portion for mounting the electrical contact to a printed circuit board and the transitional portion connects the mounting portion and the retention portion.

* * * * *